US006892886B2

(12) United States Patent
Khoo et al.

(10) Patent No.: US 6,892,886 B2
(45) Date of Patent: May 17, 2005

(54) CARRIER TAPE WITH REINFORCED RESTRAINING MEMBER

(75) Inventors: Mao Shi Khoo, ShenZhen (CN); Ru Zheng Liu, ShenZhen (CN); GuangLiang Xu, YiChang (CN); Yong Fan, ZiYang (CN); SongPing Chen, ShenZhen (CN)

(73) Assignee: e.PAK International, Inc., Austin, TX (US)

( * ) Notice: Subject to any disclaimer, the term of this patent is extended or adjusted under 35 U.S.C. 154(b) by 153 days.

(21) Appl. No.: 10/194,979

(22) Filed: Jul. 12, 2002

(65) Prior Publication Data

US 2004/0007497 A1 Jan. 15, 2004

(51) Int. Cl.[7] ..... B65D 85/86; B65D 73/02

(52) U.S. Cl. ..... 206/714

(58) Field of Search ..... 206/713, 714, 206/715, 716, 717, 718, 820

(56) References Cited

U.S. PATENT DOCUMENTS 5,076,427 A * 12/1991 Thomson et al. ..... 206/714
5,499,717 A * 3/1996 Hayashi ..... 206/701
5,791,486 A 8/1998 Brahmbhatt
5,913,425 A * 6/1999 Thomas et al. ..... 206/714
5,957,293 A 9/1999 Pakeriasamy
6,076,681 A * 6/2000 Chenoweth ..... 206/714
6,168,026 B1 * 1/2001 Haggard et al. ..... 206/714
6,536,593 B2 3/2003 Hatakeyama

* cited by examiner

*Primary Examiner*—John A. Ricci
(74) *Attorney, Agent, or Firm*—Carlson, Gaskey & Olds

(57) ABSTRACT

A carrier tape for handling electrical components includes a reinforced component restraining member. Each pocket of the carrier tape includes at least one component restraining member that resists lateral movement of a component within the pocket. The component restraining member includes a first portion having a first height or spacing from a bottom surface in the pocket. A second portion of the restraining member has a second, taller height or spacing from the bottom surface. The first, lower portion reinforces the component restraining member and strengthens it to avoid lateral deformation during shipment or handling of the carrier tape when an electrical component is placed within the pocket.

14 Claims, 2 Drawing Sheets

CARRIER TAPE WITH REINFORCED RESTRAINING MEMBER

BACKGROUND OF THE INVENTION

This invention generally relates to carrier tapes for handling electronic components. More particularly, this invention relates to a carrier tape arrangement having a reinforced restraining member for securely handling electronic components with external leads.

Carrier tapes for handling electronic components during shipment and storage are well known. A typical arrangement includes a plastic material tape with a plurality of vacuum-formed pockets into which the selected electronic components are placed for handling. A variety of carrier tapes have been designed to handle various types of electronic components.

One difficulty associated with carrier tapes is that electrical components having external leads may tend to move laterally within the pockets such that the leads pierce or penetrate the sides of the pockets. Such movement not only damages the pocket but potentially damages the leads. The further handling of the carrier tape presents the possibility for further damage or deformation to the leads.

One attempt at minimizing such problems is to include a raised surface within the pocket that is positioned to resist lateral movement of the electronic component within the pocket. The difficulty with such arrangements, however, has been that under some conditions, the raised surface collapses from the force of the laterally moving electronic component, resulting in the same problems otherwise experienced.

There is a need for an improved arrangement for a carrier tape assembly that adequately maintains electronic components with leads within the pockets and prevents undesirable lateral movement during handling. This invention addresses that need while avoiding the shortcomings and drawbacks of prior attempts.

SUMMARY OF THE INVENTION

In general terms, this invention is a carrier tape for safely handling electronic components having external leads.

One example carrier tape designed according to this invention includes a plurality of pockets formed along the tape. Each pocket has at least one sidewall extending away from a bottom surface. At least one component restraining member extends away from the bottom surface in the same general direction as the sidewall. The component restraining member has a first portion spaced a nominal distance from the bottom surface. At least one second portion of the component restraining member is spaced a second distance from the bottom surface that is greater than the nominal distance. Accordingly, the first portion reinforces the component restraining member to resist lateral deformation, thereby preventing unwanted lateral movement of the component within the pocket.

A method of making a carrier tape designed according to this invention includes forming a plurality of pockets on a carrier tape strip. Each pocket is formed with at least one component restraining member extending upward from a bottom surface within the pocket. Each component restraining member is formed with a taller portion and a shorter portion such that the height of the component restraining member varies relative to the bottom surface of the pocket.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
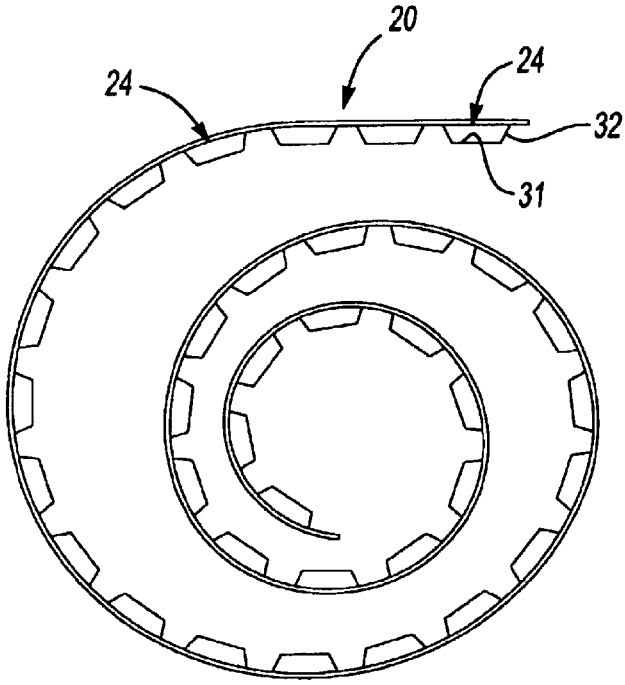
FIG. 1 schematically illustrates a carrier tape designed according to this invention.

FIG. 1 schematically illustrates a carrier tape 20 formed of a polystyrene material for handling a plurality of electrical components. The carrier tape 20 includes a plurality of pockets 24 each for containing an electrical component 26.

Although the invention is not limited to any particular electrical components, the preferred embodiments of this invention are particularly well suited for electrical components 26 having a body portion 28 and at least one electrical lead 30 that is external to the body portion 28. For purposes of discussion an electrical component 26 having two electrical leads 30 extending out of one side of the body portion 28 is used as one example component for which the embodiments of FIGS. 2–6 are well suited.

Figure 2:
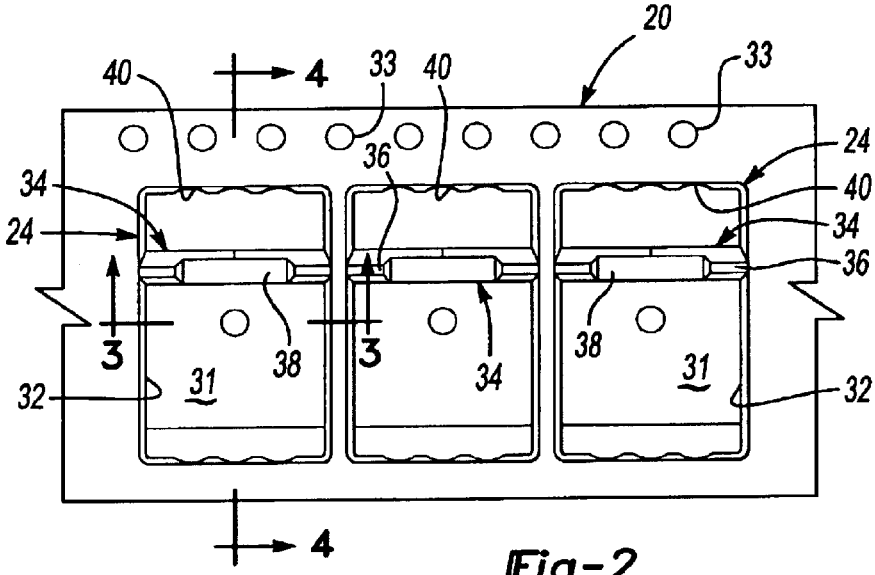
FIG. 2 is a top elevational view of a selected portion of the embodiment of FIG. 1.
Figure 3:
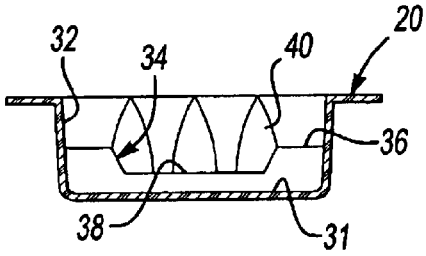
FIG. 3 is a cross-sectional illustration taken along the lines 3—3 in FIG. 2.
Figure 4:
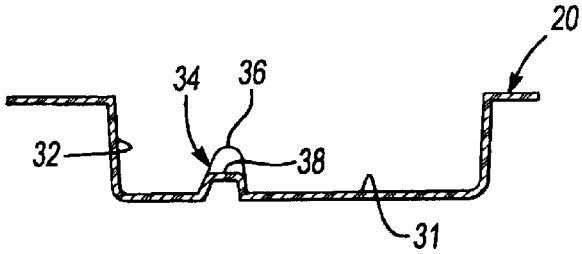
FIG. 4 is a cross sectional illustration taken along the lines 4—4 in FIG. 2.

As can be appreciated from FIG. 2, the carrier tape 20 includes a plurality of pockets 24 each having a bottom surface 31 and at least one side wall 32 extending away from the bottom surface. Depending on the configuration of the sidewall 32, there may be four discrete sections or portions of the sidewall 32 as shown in the illustrated example. Depending on the type of component and the desired packaging density on the carrier tape, other sidewall configurations may be used.

Indexing holes 33 are provided on the carrier tape for conventional reasons.

Each pocket 24 includes a component restraining member 34. The example arrangement of FIGS. 2–6 includes two taller portions 36 and one shorter portion 38 along the length of the component restraining member 34. The shorter portion 38 preferably is spaced a first, nominal distance from the bottom surface 31 of the pocket 24. The top surface of the portions 36 are spaced a second, greater distance from the bottom surface 31. Accordingly, the component restraining member 34 has a varying height along the length of the restraining member.

In the illustrated example, the portions 36 have a generally arcuate or rounded top surface. The reinforcing portion 38 preferably is flat or generally planar across the top surface.

The entire component restraining member 34 preferably is vacuum formed at the same time as the pocket 24.

Figure 5:
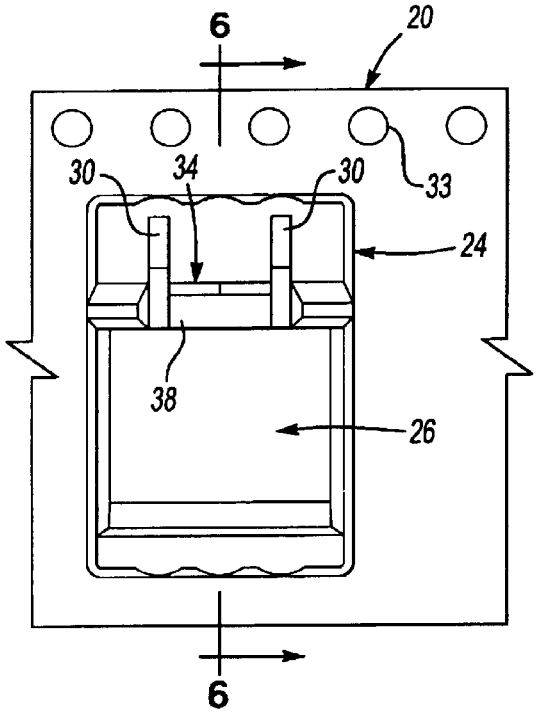
FIG. 5 shows a pocket of the embodiment of FIG. 2 with an electrical component in place.
Figure 6:
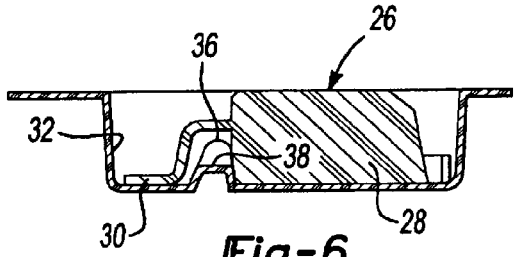
FIG. 6 is a cross-sectional illustration taken along the lines 6—6 in FIG. 5.

FIGS. 5 and 6 illustrate an electrical component 26 supported within a pocket 24. As can be appreciated from these drawings, the component retaining member 34 sits against at least one surface of the component body 28 and prevents lateral movement in a direction where the leads 30 would tend to contact or even penetrate the sidewall 32 of the pocket 24. The flattened reinforcing portion 38 enhances the strength of the retaining member 34 so that such lateral movement is not possible.

The preferred arrangement includes corrugated modifications 40 to at least one of the portions of the sidewall 32 in an area that is most likely to be contacted by one of the electrical leads 30 in the event of lateral movement of the component 26. Such corrugations reinforce the strength of the sidewall 32 in the corresponding region. The corrugations can be formed during the vacuum forming process used to form the pocket and the component restraining member 34.

Figure 7:
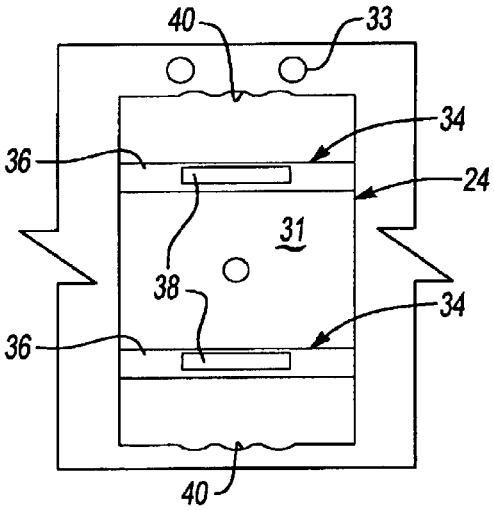
FIG. 7 illustrates an alternative arrangement having a plurality of component restraining members within a pocket.

FIG. 7 illustrates an alternative arrangement having two component restraining members 34 within a single pocket. This particular arrangement is useful, for example, for electrical components that have leads 30 extending out of opposite sides of the body 28.

Figure 8:
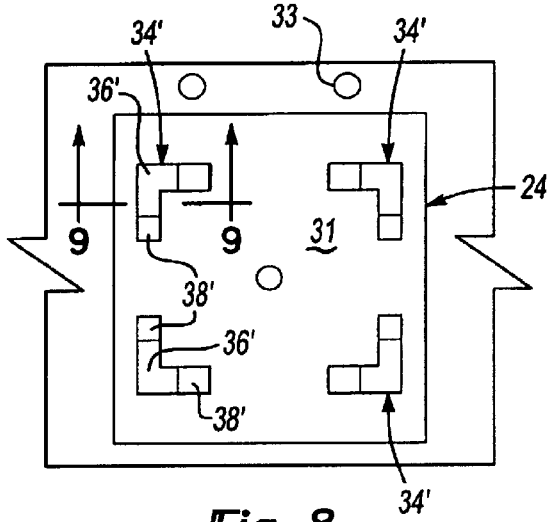
FIG. 8 illustrates another example restraining member arrangement designed according to this invention.
Figure 9:
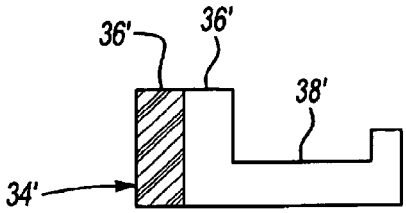
FIG. 9 is a cross sectional illustration taken along the lines 9—9 in FIG. 8.

Another arrangement is shown in FIGS. 8 and 9, which is particularly well suited for accommodating components 26 having leads 30 extending out from all four sides of the body 28 (in the event that the body is rectangular, for example). In this example, the component restraining members 34' are positioned at the corners of the placement for the body portion 28 of the component 26. Each restraining member (i.e., at each of the four corners) includes a larger portion 36' and a shorter, reinforcing portion 38'. The larger portion 36' in one example includes a generally arcuate or rounded top surface while the shorter, flattened portions 38' include a general planar top surface.

A variety of other configurations of component restraining members having a varying height as disclosed are within the scope of this invention. Those skilled in the art who have the benefit of this description will realize what arrangement of the inventive reinforced restraining members will best meet the needs of their particular situation.

A method of making a carrier assembly designed according to this invention includes placing a carrier tape blank strip 20' within a mold. At least one portion of the mold includes a surface contour that facilitates fanning the retaining member 34 giving the desired configuration. A conventional vacuum source creates the necessary vacuum within the mold to form the pockets and component retaining members. Conventional vacuum forming techniques appropriate for the material chosen to form the carrier tape can be used.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A carrier tape and electrical component assembly, comprising:

a carrier tape having a plurality of pockets formed along the tape, each pocket having a bottom surface and at least one sidewall extending away from the bottom surface and at least one component restraining member having a side extending away from the bottom surface and having a first portion spaced a nominal distance from the bottom surface and at least one second portion spaced a second, greater distance from the bottom surface such that the first portion reinforces the component restraining member; and an electrical component received at least partially within the pocket such that one surface of the electrical component contacts the bottom surface of the pocket and another surface on the electrical component is received adjacent the side of the restraining member such that the restraining member controls movement of the electrical component relative to the bottom surface.

2. The assembly of claim 1, wherein the first portion includes a generally planar surface.

3. The assembly of claim 1, wherein the first portion has a surface that is generally parallel to the bottom surface.

4. The assembly of claim 1, wherein the second portion includes a generally arcuate surface.

5. The assembly of claim 1, wherein the second portion includes a generally polygonal surface.

6. The assembly of claim 1, wherein at least one selected region of the sidewall includes corrugations.

7. Tho assembly of claim 1, wherein each component restraining member includes perpendicular second portions with first portions at each end of each second portion.

8. The assembly of claim 1, wherein the first portion is centered between two second portions that each extend between the first portion and corresponding locations on the sidewall.

9. A carrier tape and electrical component assembly, comprising:

a carrier tape having a plurality of pockets, each having a bottom surface and at least one component restraining member at least partially within the pocket having varying heights from the bottom surface along the length of the component restraining member; and an electrical component at least partially received within the pocket such that one surface of the electrical component contacts the bottom surface and a second surface on the electrical component is received adjacent the component restraining member such that the component restraining member cooperates with the second surface to control movement of the electrical component relative to the bottom surface.

10. The assembly of claim 9, wherein the component restraining member has a first portion that is lower than and centered between two higher second portions.

11. The assembly of claim 10, wherein the first portion includes a generally flat surface.

12. The assembly of claim 11, wherein the generally flat surface of the first portion is parallel with the bottom surface.

13. The assembly of claim 9, including corrugations in a selected region of a sidewall of the pocket.

14. The assembly of claim 9, wherein the component restraining member has a first section that is generally perpendicular to a second section and wherein each section has a first portion extending a first height away from the bottom surface and a second portion extending a second height away from the bottom surface.

* * * * *